US009696680B2

(12) United States Patent
Kawasaki et al.

(10) Patent No.: US 9,696,680 B2
(45) Date of Patent: Jul. 4, 2017

(54) TRANSFER-SECTION CONTAMINATION PREVENTION DEVICE AND IMAGE FORMING APPARATUS

(71) Applicant: Konica Minolta, Inc., Chiyoda-ku, Tokyo (JP)

(72) Inventors: Tomohiro Kawasaki, Kanagawa (JP); Tetsuya Ishikawa, Kanagawa (JP); Natsuko Kawai, Tokyo (JP); Tatsuya Furuta, Tokyo (JP); Shota Sakurai, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/055,731

(22) Filed: Feb. 29, 2016

(65) Prior Publication Data

US 2016/0259292 A1 Sep. 8, 2016

(30) Foreign Application Priority Data

Mar. 4, 2015 (JP) ..... 2015-042318

(51) Int. Cl.
*G03G 21/00* (2006.01)
*G03G 15/16* (2006.01)
*G03G 21/16* (2006.01)

(52) U.S. Cl.
CPC ..... *G03G 21/00* (2013.01); *G03G 15/161* (2013.01); *G03G 21/168* (2013.01); *G03G 15/1695* (2013.01)

(58) Field of Classification Search
CPC ..... G03G 15/1695; G03G 21/00
USPC ..... 399/98, 390
See application file for complete search history.

(56) References Cited

U.S. PATENT DOCUMENTS 8,923,712 B1 * 12/2014 Kiuchi ..... G03G 15/0822 399/390
2015/0370194 A1 * 12/2015 Kiuchi ..... G03G 15/0822 399/390

FOREIGN PATENT DOCUMENTS

JP 6-230727 A 8/1994
JP 8-12133 A 1/1996
JP 2015-11047 A 1/2015

OTHER PUBLICATIONS

Office Action (Notice of Reasons for Rejection) issued Jan. 4, 2017 by the Japanese Patent Office in corresponding Japanese Patent Application No. 2015-042318, and English translation of Office Action (7 pages).

* cited by examiner

*Primary Examiner* — Sandra Brase
(74) *Attorney, Agent, or Firm* — Buchanan Ingersoll & Rooney PC

(57) ABSTRACT

A transfer-section contamination prevention device includes: a powder housing section that is disposed on an upstream side relative to a transfer section in a sheet conveyance direction, and is capable of holding powder at a position near an end portion of a sheet in a sheet width direction orthogonal to the sheet conveyance direction or capable of guiding the powder to the position near the end portion of the sheet, the sheet including a base material layer, a release layer and an adhesive layer containing adhesive agent disposed between the base material layer and the release layer, the transfer section being configured to transfer a toner image to the sheet; and a powder adhesion facilitation section configured to facilitate adhesion of the powder to the lateral end portion of the sheet from the powder housing section.

12 Claims, 9 Drawing Sheets

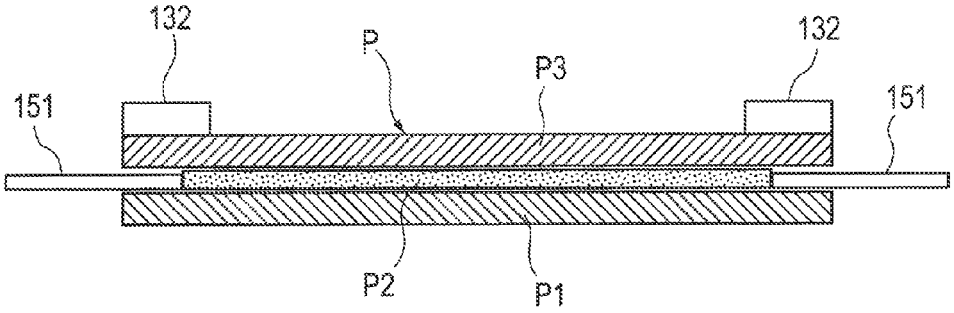

FIG. 17

| | COMPARATIVE EXAMPLE | EMBODIMENT 1 | EMBODIMENT 2 | EMBODIMENT 3 | EMBODIMENT 4 |
|---|---|---|---|---|---|
| SUPPLY OF POWDER | NOT PROVIDED | PROVIDED | PROVIDED | PROVIDED | NOT PROVIDED |
| GUIDE MEMBER | NOT PROVIDED | NOT PROVIDED | NOT PROVIDED | PROVIDED | PROVIDED |

TRANSFER OF ADHESIVE AGENT/WHITE STREAK IMAGE

| CONVEYANCE DISTANCE | COMPARATIVE EXAMPLE | EMBODIMENT 1 | EMBODIMENT 2 | EMBODIMENT 3 | EMBODIMENT 4 |
|---|---|---|---|---|---|
| 0 | GOOD/GOOD | GOOD/GOOD | GOOD/GOOD | GOOD/GOOD | GOOD/GOOD |
| 0.5 | FAIR/FAIR | GOOD/GOOD | GOOD/GOOD | GOOD/GOOD | GOOD/GOOD |
| 1 | POOR/POOR | GOOD/GOOD | GOOD/GOOD | GOOD/GOOD | GOOD/GOOD |
| 1.5 | POOR/POOR | GOOD/GOOD | GOOD/GOOD | GOOD/GOOD | FAIR/FAIR |
| 2 | POOR/POOR | GOOD/GOOD | GOOD/GOOD | GOOD/GOOD | FAIR/FAIR |

FIG. 18

TRANSFER-SECTION CONTAMINATION PREVENTION DEVICE AND IMAGE FORMING APPARATUS

CROSS REFERENCE TO RELATED APPLICATIONS

This application is entitled to and claims the benefit of Japanese Patent Application No. 2015-042318, filed on Mar. 4, 2015, the disclosure of which including the specification, drawings and abstract is incorporated herein by reference in its entirety.

BACKGROUND OF THE INVENTION

1. Field of the Invention

The present invention relates to a transfer-section contamination prevention device and an image forming apparatus.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to the sheet, and thereafter fixed through heating and pressing at a fixing nip of a heating member (for example, a fixing roller) and a pressing member (for example, a pressure roller), thereby forming an image on the sheet.

Conventionally, image formation systems have been practically used in which a sheet feeding apparatus that feeds a continuous sheet such as continuous roll paper and folded paper is connected at the preceding side of the image forming apparatus, and a winding apparatus that winds up the sheet on which an image has been formed by the image forming apparatus is connected at the succeeding side of the image forming apparatus.

Examples of the sheets used in the above-mentioned image formation system include, in addition to common sheets composed only of paper, a sheet called label sheet which contains paste (adhesive agent) for pasting. Examples of such a label sheet include, in addition to short sheets such as A4-sheets, rolled long sheets of several hundred meters long in one roll (hereinafter referred to as "label roll sheet").

Meanwhile, when a label sheet containing adhesive agent is used in the above-mentioned image formation system, the adhesive agent of an end portion of the label sheet may possibly leak with pressure exerted on the sheet at the time of transferring a toner image on the label sheet or at the time of fixation after transfer of a toner image. If the leaked adhesive agent adheres on the movable section (transfer section) including the transfer belt and the transfer roller, cleaning defects and image defects may possibly be caused.

As a device for removing foreign matters adhered on the surface of a photoconductor, Japanese Patent Application Laid-Open No. 6-230727 discloses a photoconductor cleaning device, for example. The photoconductor cleaning device includes a cleaning blade configured to peel and remove foreign matters adhered on the surface of the photoconductor, and the contact angle and the pressing linear load of the cleaning blade to the photoconductor surface are set for the purpose of removing the foreign matters adhered on the surface of the photoconductor.

In the photoconductor cleaning device disclosed in Japanese Patent Application Laid-Open No. 6-230727; however, when the foreign matter adhered on the surface of the photoconductor is adhesive agent leaked from a label sheet containing the adhesive agent for example, the adhesive agent having adhesiveness may not be surely removed from the surface of the photoconductor, and the remaining adhesive agent may transfer to a transfer section, thus causing cleaning defects and image defects.

SUMMARY OF THE INVENTION

An object of the present invention is to provide a transfer-section contamination prevention device and an image forming apparatus which can suppress transfer of leaked adhesive agent to a transfer section when the adhesive agent leaks from the label sheet.

To achieve the above-mentioned object, a transfer-section contamination prevention device reflecting one aspect of the present invention includes: a powder housing section that is disposed on an upstream side relative to a transfer section in a sheet conveyance direction, and is capable of holding powder at a position near an end portion of a sheet in a sheet width direction orthogonal to the sheet conveyance direction or capable of guiding the powder to the position near the end portion of the sheet, the sheet including a base material layer, a release layer and an adhesive layer containing adhesive agent disposed between the base material layer and the release layer, the transfer section being configured to transfer a toner image to the sheet; and a powder adhesion facilitation section configured to facilitate adhesion of the powder to the lateral end portion of the sheet from the powder housing section.

An image forming apparatus reflecting another aspect of the present invention includes: the above-mentioned transfer-section contamination prevention device.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 17 is a sectional view taken along line K-K of FIG. 11; and

FIG. 18 shows results of an experiment for confirming the effectiveness of the present invention.

DESCRIPTION OF THE PREFERRED EMBODIMENTS

In the following, embodiments are described in detail with reference to the accompanying drawings.

(Embodiment 1)

Figure 1:
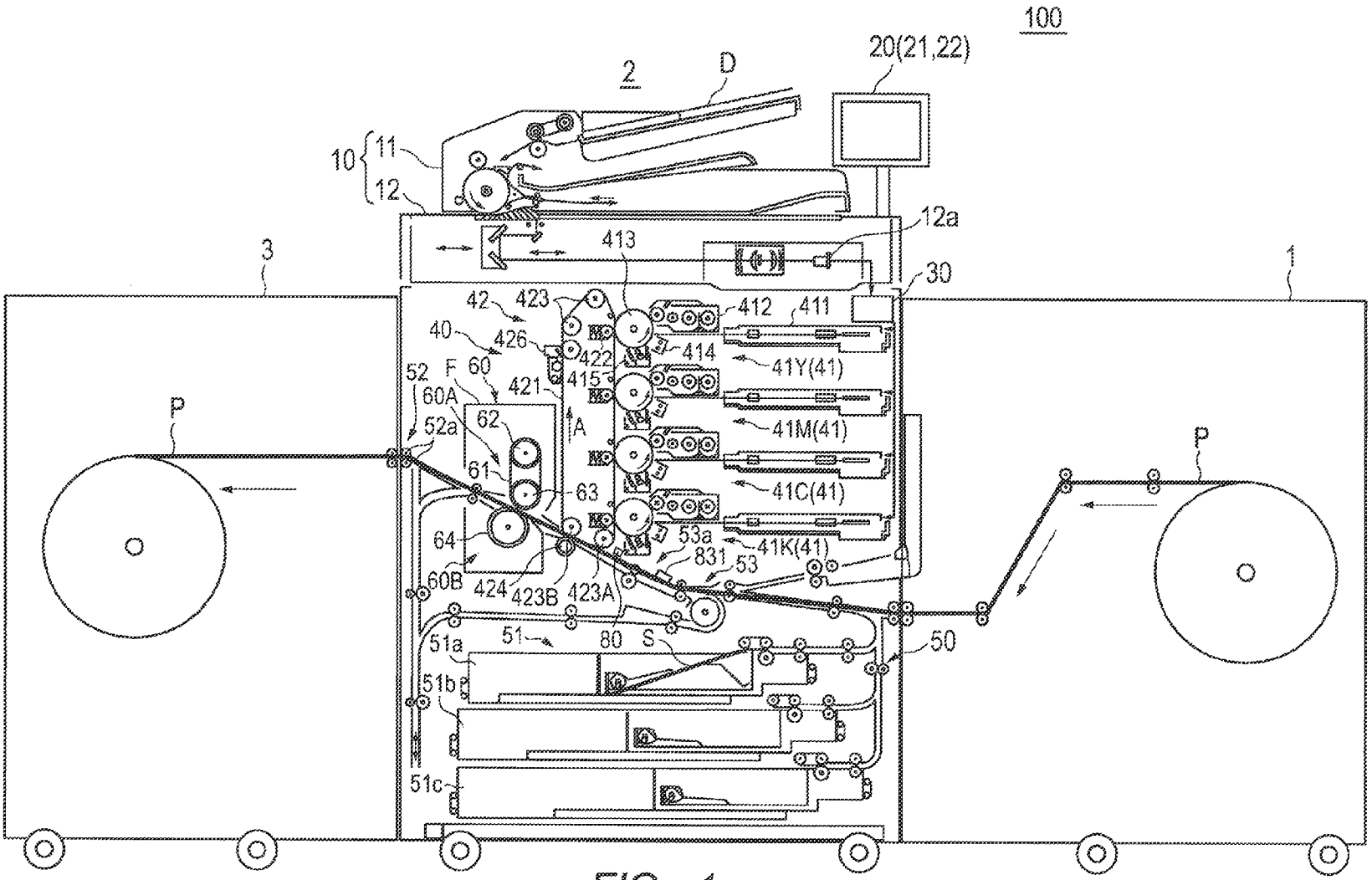
FIG. 1 schematically illustrates a general configuration of an image formation system of Embodiment 1.
Figure 2:
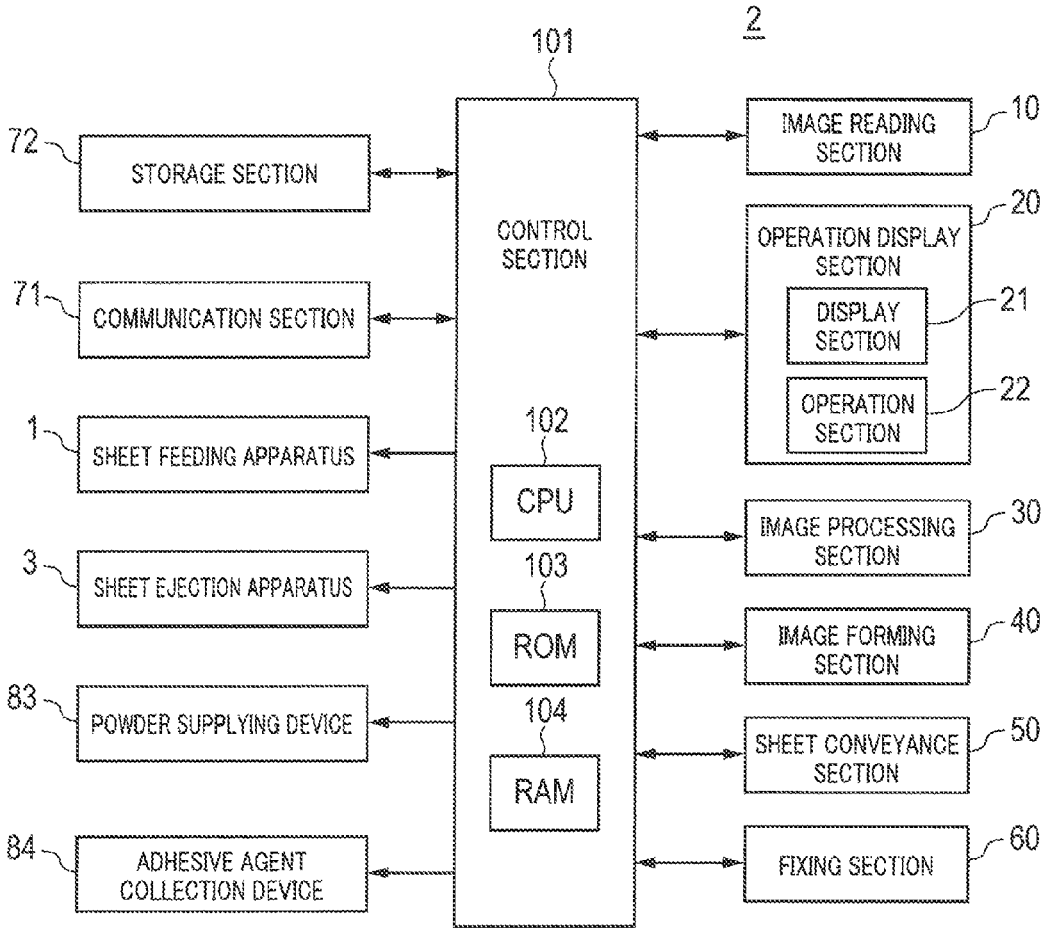
FIG. 2 illustrates a configuration of a principal part of a control system of the image forming apparatus of Embodiment 1.

FIG. 1 schematically illustrates a general configuration of image forming system 100 according to Embodiment 1 of the present invention. FIG. 2 illustrates a configuration of a principal part of a control system of image forming apparatus 2 of image formation system 100 according to the present embodiment. Image formation system 100 is a system that uses long sheet P indicated with the heavy line in FIG. 1, or sheets (also referred to as "cut paper") S cut into a predetermined paper size as a recording medium, and forms an image on long sheet P or sheet S. Here, long sheet P is a sheet which has a length greater than the width of the main body of image forming apparatus 2 in the conveyance direction, for example. In the present embodiment, a label roll sheet is used as long sheet P. In the following description, long sheet P is referred to as label roll sheet P.

Figure 3:
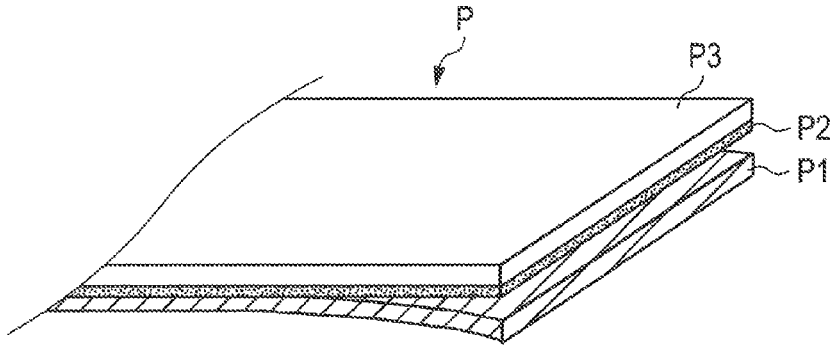
FIG. 3 illustrates a structure of a commonly used label roll sheet.

FIG. 3 illustrates a structure of commonly-used label roll sheet P. As illustrated in FIG. 3, label roll sheet P has a structure in which base material P3 whose rear surface (the surface for releasing agent) is covered with paste P2 is attached on release sheet P1 on which releasing agent is applied. After an image is formed on the surface of base material P3, release sheet P1 is peeled off and label roll sheet P is stuck on an object when in use.

As illustrated in FIG. 1, in image forming system 100, sheet feeding apparatus 1, image forming apparatus 2 and sheet ejection apparatus 3 are connected to each other from the upstream side in the conveyance direction of label roll sheet P (hereinafter referred to also as "sheet conveyance direction"). Sheet feeding apparatus 1 and sheet ejection apparatus 3 are used in the case where a long sheet such as label roll sheet P is used.

Sheet feeding apparatus 1 is an apparatus that feeds label roll sheet P to image forming apparatus 2. As illustrated in FIG. 1, in the housing of sheet feeding apparatus 1, label roll sheet P in a roll form is wound around a support shaft and is rotatably held. Sheet feeding apparatus 1 conveys, via a plurality of conveyance roller pairs (for example, delivery rollers, sheet feed rollers and the like), label roll sheet P wound around the support shaft to image forming apparatus 2 at a constant speed. The sheet feeding operation of sheet feeding apparatus 1 is controlled by control section 101 of image forming apparatus 2.

It is to be noted that, in sheet feeding apparatus 1, label roll sheet P may not be held in a roll shape, and a plurality of label roll sheets P of a predetermined size (for example, 210 [mm]×1200 [mm]) may be held.

Image forming apparatus 2 is a color-image forming apparatus of an intermediate transfer system using electrophotographic process technology. Specifically, image forming apparatus 2 primary-transfers toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 2 secondary-transfers the resultant image to label roll sheet P fed from sheet feeding apparatus 1 or sheet S sent from sheet feed tray units 51*a* to 51*c*, to thereby form an image.

A longitudinal tandem system is adopted for image forming apparatus 2. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 2 includes image reading section 10, operation display section 20, image processing section 30, image forming section 40, sheet conveyance section 50, fixing section 60, communication section 71, storage section 72, powder supplying device 83, adhesive agent collection device 84 and control section 101.

Control section 101 includes central processing unit (CPU) 102, read only memory (ROM) 103, random access memory (RAM) 104 and the like. CPU 102 reads out a program corresponding to processing details from ROM 103, loads the program in RAM 104, and performs a centralized control of operations of the blocks and the like of image forming apparatus 2 in conjunction with the loaded program. At this time, CPU 101 refers to various kinds of data stored in storage section 72. Storage section 72 is composed of, for example, a non-volatile semiconductor memory (so-called flash memory) or a hard disk drive.

Control section 101 transmits and receives various data to and from an external apparatus (for example, a personal computer) connected to a communication network such as a local area network (LAN) or a wide area network (WAN), through communication section 71. Control section 101 receives, for example, image data transmitted from the external apparatus, and performs control to form an image on label roll paper P or sheet S on the basis of the image data (input image data). Communication section 71 is composed of, for example, a communication control card such as a LAN card.

As illustrated in FIG. 1, image reading section 10 includes auto document feeder (ADF) 11, document image scanning device 12 (scanner), and the like. Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image conditions, operating statuses of functions, and the like in accordance with display control signals received from control section 101. Operation section 22 includes various operation keys such as numeric keys and a start key, receives various input operations performed by a user, and outputs operation signals to control section 101.

Image processing section 30 includes a circuit that performs a digital image process suited to initial settings or user settings on the input image data, and the like. For example, image processing section 30 performs tone correction on the basis of tone correction data (tone correction table), under the control of control section 101. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like. Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415 and the like.

Photoconductor drum 413 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm]. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 101 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image. Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like. Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [logΩ·cm]. Intermediate transfer belt 421 is rotationally driven by a control signal from control section 101. It is to be noted that the material, thickness and hardness of intermediate transfer belt 421 are not limited as long as intermediate transfer belt 421 has conductivity and elasticity.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to label roll sheet P or sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when label roll sheet P or sheet S passes through the secondary transfer nip, the toner image on intermediate transfer belt 421 is secondary-transferred to label roll sheet P or sheet S. To be more specific, a secondary transfer bias is applied to secondary transfer roller 424, and an electric charge of the polarity opposite to the polarity of the toner is applied to the rear side (the side that makes contact with secondary transfer roller 424) of label roll sheet P or sheet S, whereby the toner image is electrostatically transferred to label roll sheet P or sheet S. Label roll sheet P or sheet S on which the toner images have been transferred is conveyed toward fixing section 60.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) side of label roll sheet P or sheet S, lower fixing section 60B having a back side supporting member disposed on the rear surface (the surface opposite to the fixing surface) side of label roll sheet P or sheet S, and the like. The back side supporting member is brought into pressure contact with the fixing side member, whereby a fixing nip for conveying label roll sheet P or sheet S in a tightly sandwiching manner is formed.

At the fixing nip, fixing section 60 applies heat and pressure to label roll sheet P or sheet S on which a toner image has been secondary-transferred to fix the toner image on label roll sheet P or sheet S. Fixing section 60 is disposed as a unit in fixing part F. In addition, fixing part F may be provided with an air-separating unit that blows air to separate label roll sheet P or sheet S from the fixing side member or the back side supporting member.

Upper side fixing section 60A includes endless fixing belt 61, heating roller 62 and fixing roller 63, which serve as a fixing side member (belt heating system). Fixing belt 61 is installed in a stretched state around heating roller 62 and fixing roller 63 with a predetermined belt tensile force (for example, 40 [N]).

Regarding fixing belt 61, for example, a PI (polyimide) having a thickness of 80 [μm] is used as a base, and the outer peripheral surface of the base is covered with a heat-resistant silicon rubber (JIS-A hardness:30°) having a thickness of 250 [μm] as an elastic layer. Further, the surface layer has a coating of a PFA (perfluoro alkoxy), which is a heat-resistant resin, having a thickness of 70 [μm]. Fixing belt 61 has an outer diameter of 100 [mm] for example. Fixing belt 61 makes contact with label roll sheet P or sheet S on which a toner image is formed, and thermally fixes the toner image on label roll sheet P or sheet S at a fixation temperature (for example, 160 to 200[° C.]). The fixing temperature is a temperature at which a heat energy required for melting the toner on label roll sheet P or sheet S can be obtained, and the fixing temperature differs depending on factors such as the type of label roll sheet P or sheet S on which an image is to be formed.

Heating roller 62 incorporates a heating source (halogen heater) and applies heat to fixing belt 61. The heating source applies heat to heating roller 62, and as a result, fixing belt 61 is heated. The temperature of the heating source is controlled by control section 101 such that the temperature of fixing belt 61 is 180[° C.] which is a setting temperature. Heating roller 62 has an outer diameter of 50 [mm], for example.

Fixing roller 63 has a structure in which an elastic layer (thickness: 10 mm, for example) made of silicone rubber or the like and a surface layer (thickness: 70 mm, for example) made of a fluorine resin such as a PTFE resin are sequentially stacked on the outer peripheral surface of a cylindrical mandrel made of aluminum or the like, for example. Fixing roller 63 has an outer diameter of 40 [mm] for example. Fixing roller 63 is driven and controlled (for example, turn on/off of rotation, circumferential velocity, and the like) by control section 101. Control section 101 rotates fixing roller 63 in the clockwise direction. When fixing roller 63 rotates, fixing belt 61 and heating roller 62 rotate in the clockwise direction to follow the rotation of fixing roller 63.

Lower fixing section 60B includes pressure roller 64 serving as a back side supporting member (roller pressing type). Pressure roller 64 has a structure in which an elastic layer made of silicone rubber or the like and a surface layer composed of a PFA-tube are sequentially formed on the outer peripheral surface of a cylindrical mandrel made of iron or the like, for example. Pressure roller 64 has an outer diameter of 40 [mm] for example. Pressure roller 64 is brought into pressure contact with fixing roller 63 with fixing belt 61 therebetween with a predetermined fixing load (for example, 1000 [N]) by a pressure contact separation section (not illustrated).

The pressure contact separation section has a conventional configuration, and brings fixing belt 61 and pressure roller 64 into pressure contact with each other or separates fixing belt 61 and pressure roller 64 from each other. Thus, a fixing nip for conveying label roll sheet P or sheet S in a tightly sandwiching manner is formed between fixing belt 61 and pressure roller 64. Pressure roller 64 and the pressure contact separation section are driven and controlled (for example, on/off of rotation, circumferential velocity, and the like) by control section 101. Control section 101 rotates pressure roller 64 in the counterclockwise direction.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 has a plurality of pairs of conveyance rollers including a pair of registration rollers 53*a*. A registration roller section in which registration roller pair 53*a* is arranged corrects skew and displacement of sheet S or label roll sheet P.

Sheets S stored in sheet tray units 51*a* to 51*c* are output one by one from the uppermost, and conveyed to image forming section 40 through conveyance path section 53. In image forming section 40, the toner image on intermediate transfer belt 421 is secondary-transferred to one side of sheet S at one time, and a fixing process is performed in fixing section 60. In addition, label roll sheet P fed from sheet feeding apparatus 1 to image forming apparatus 2 is conveyed to image forming section 40 through conveyance path section 53. Then, in image forming section 40, the toner image on intermediate transfer belt 421 is secondary-transferred to one side of label roll sheet P at one time, and a fixing process is performed in fixing section 60. Label roll sheet P or sheet S on which an image has been formed is conveyed to sheet ejection apparatus 3 by sheet ejection section 52 having conveyance roller pair (sheet ejection roller pair) 52*a*.

Sheet ejection apparatus 3 is an apparatus for winding up and housing label roll sheet P conveyed from image forming apparatus 2. As illustrated in FIG. 1, in the housing of sheet ejection apparatus 3, label roll sheet P is wound around a support shaft and held in a roll form for example. As such, sheet ejection apparatus 3 winds up label roll sheet P conveyed from image forming apparatus 2 around the support shaft at a constant speed via a plurality of conveyance roller pairs (for example, delivery rollers and sheet ejection rollers). The winding operation of sheet ejection apparatus 3 is controlled by control section 101 of image forming apparatus 2.

Figure 4:
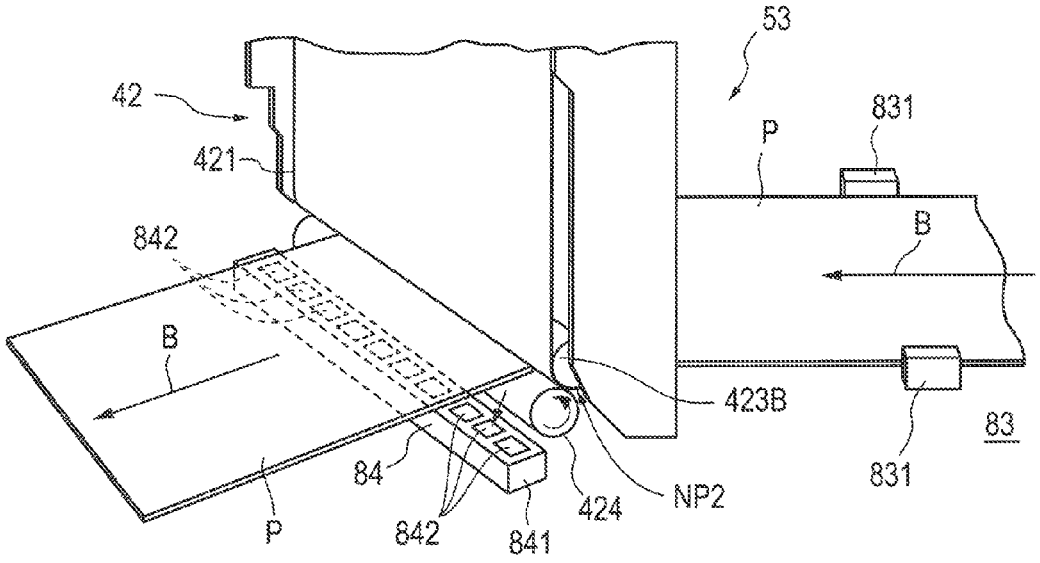
FIG. 4 is a perspective view illustrating an external appearances of a portion of an intermediate transfer unit on a conveyance path section side, a shield member of a powder supplying device and an adhesive agent collection device in Embodiment 1.

FIG. 4 is a perspective view illustrating external appearances of a part of intermediate transfer unit 42 on the conveyance path section 53 side, shield member 831 of powder supplying device 83 and adhesive agent collection device 84. As described in detail later, in FIG. 4, powder supplying device 83 is a device configured to supply powder to both end portions (hereinafter referred to as "lateral end portions") of label roll sheet P in the sheet width direction at a position on the upstream side of secondary transfer nip NP2 in the sheet conveyance direction of label roll sheet P (the arrow B direction in the drawing). The operation of powder supplying device 83 is controlled by control section 101 of image forming apparatus 2.

Figure 5:
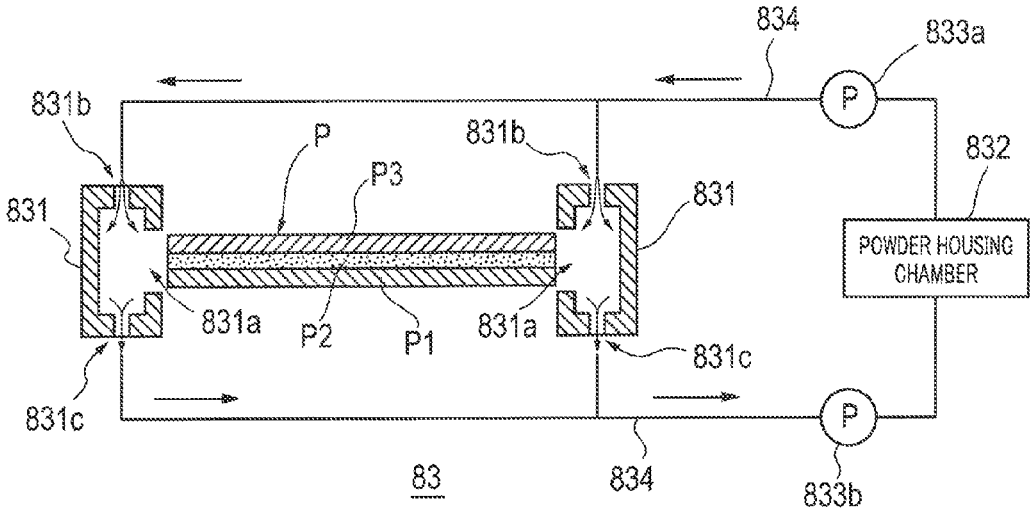
FIG. 5 illustrates a schematic configuration of the powder supplying device of Embodiment 1.

FIG. 5 illustrates a schematic configuration of powder supplying device 83. It is to be noted that, in FIG. 5, shield member 831 is illustrated in cross-section. Powder supplying device 83 includes two shield members 831, powder housing chamber 832 configured to house powder, two pumps 833*a* and 833*b*, and pipe 834 configured to connect shield member 831, powder housing chamber 832 and pumps 833*a* and 833*b*. Here, dusting powder mainly composed of starch is used as the powder, for example.

Shield member 831 is a member having a hollow square-shape, and is provided with opening 831*a* for supplying powder on a surface which faces an end portion of label roll sheet P when shield member 831 is disposed at a position corresponding to label roll sheet P. In addition, the top surface orthogonal to the surface provided with opening 831*a* is provided with inflow hole 83 lb for taking in the powder, and the bottom surface orthogonal to the surface provided with opening 831*a* is provided with ejection hole 831*c* for ejecting the powder. Each of two shield members 831 is disposed in the proximity of an end portion of label roll sheet P such that opening 831*a* faces a lateral end portion of label roll sheet P, and that adhesive agent P2 exposed at the lateral end portion of label roll sheet P can be enclosed. In addition, the positions of two shield members 831 with respect to the sheet width direction of label roll sheet P can be adjusted, and therefore label roll sheets P having different sheet widths can be handled.

In the present embodiment, shield member 831 is configured as a powder housing section capable of holding or guiding powder at a position near a lateral end portion of label roll sheet P and on the upstream side relative to the transfer section in the sheet conveyance direction.

Pump 833*a* sucks powder housed in powder housing chamber 832, and sends the powder to two shield members 831 through a spray nozzle (not illustrated) provided at inflow hole 831*b*. Pump 833*b* sucks the powder taken in two shield members 831, and sends the power to powder housing chamber 832. With the operations of pumps 833*a* and 833*b*, the powder housed in powder housing section 832 enters two shield members 831, and disperses in shield members 831. The powder dispersed in shield member 831 adheres on adhesive agent P2 exposed at a lateral end portion of label roll sheet P which faces opening 831*a* with the adhesive force of adhesive agent P2, and the excess dispersed powder in shield member 831 is collected to powder housing chamber 832.

In the present embodiment, pumps 833*a* and 833*b* are configured as a powder adhesion facilitation section configured to facilitate adhesion of powder from shield member 831 to a lateral end portion of label roll sheet P, and the spray nozzle of pump 833*a* is configured as a dispersion section configured to disperse the powder in the interior of shield member 831.

The powder adheres to adhesive agent P2 exposed at a lateral end portion of label roll sheet P before a toner image on intermediate transfer belt 421 is secondary transferred to label roll sheet P, and thus the powder is contained in adhesive agent P2 which leaks at the time of pressing at secondary transfer nip NP2. The adhesiveness of adhesive agent P2 containing the powder is low, and the transfer to secondary transfer belt 421, secondary transfer roller 424 and the like is not easily caused. While FIG. 5 illustrates an exemplary case where one shield member 831 is disposed at each lateral end portion of label roll sheet P, the number of shield members 831 is not limited to this, and a plurality of shield members 831 may be provided.

Adhesive agent collection device 84 illustrated in FIG. 4 is a device configured to collect adhesive agent P which has leaked from a lateral end portion of label roll sheet P due to pressing at secondary transfer nip NP2. Adhesive agent collection device 84 is formed in a rectangular box shape 841 having a length substantially equal to that of secondary transfer roller 424. Adhesive agent collection device 84 is provided with a plurality of suction ducts 842 which are disposed along the longitudinal direction of the device main body at predetermined intervals. In addition, each suction duct 842 is provided with a shutter mechanism not illustrated, and in accordance with the sheet width of label roll sheet P, the shutter of suction duct 842 where suction is required is opened, and the shutter of suction duct 842 where suction is not required is closed. The opening and closing of the shutter mechanism for suction ducts 842 of adhesive agent collection device 84 are controlled by control section 101 of image forming apparatus 2.

Adhesive agent collection device 84 is disposed to face the lateral end portions of label roll sheet P and secondary transfer roller 424 at a position on the downstream side relative to intermediate transfer unit 42 in the sheet conveyance direction, and is configured to suck and collect adhesive agent P2 adhered on the lateral end portions of label roll sheet P, a part of secondary transfer belt 421 which makes contact with the lateral end portions of label roll sheet P, or a part of secondary transfer roller 424 which makes contact with label roll sheet P.

That is, in the present embodiment, adhesive agent collection device 84 is configured as a collection section configured to suck and collect adhesive agent P2 on which powder is attached from the lateral end portions of label roll sheet P at a position on the downstream side relative to the transfer section in the sheet conveyance direction.

Since adhesive agent P2 leaked from the lateral end portions of label roll sheet P contains the powder, adhesive agent P2 leaked from the lateral end portions of label roll sheet P can be readily collected through suction ducts 842. Since the adhesiveness of adhesive agent P2 thus collected is low, adhesive agent P2 can be discarded using a conveyance path of waste toner, for example.

According to Embodiment 1 having the above-mentioned configuration, powder is supplied to lateral end portions of label roll sheet P at powder supplying device 83 disposed on the upstream side relative to intermediate transfer unit 42 of image forming section 40 in the sheet conveyance direction of label roll sheet P so that the powder adheres to adhesive agent P2 exposed at the lateral end portions of label roll sheet P. With this configuration, even in the case where label roll sheet P is pressed at secondary transfer nip NP2 of intermediate transfer unit 42 and adhesive agent P2 leaks from the lateral end portions, transfer to the movable section (transfer section) such as secondary transfer belt 421 and secondary transfer roller 424 can be suppressed since leaked adhesive agent P2 contains powder and its adhesiveness is low. Thus, the possibility of cleaning defects and image defects due to transfer of adhesive agent P to the transfer section is reduced.

In addition, adhesive agent P2 pressed at secondary transfer nip NP2 of intermediate transfer unit 42 and leaked from the lateral end portions of label roll sheet P is collected by adhesive agent collection device 84 which is disposed to face the lateral end portions of label roll sheet P and secondary transfer roller 424 at a position on the downstream side relative to intermediate transfer unit 42 in the sheet conveyance direction. Since the adhesiveness of adhesive agent P2 thus collected is low, adhesive agent P2 can be readily discarded.

In the present embodiment, powder supplying device 83 or the combination of powder supplying device 83 and adhesive agent collection device 84 is configured as a transfer-section contamination prevention device configured to prevent contamination by adhesive agent P2 in the transfer section.

(Embodiment 2)

Figure 6:
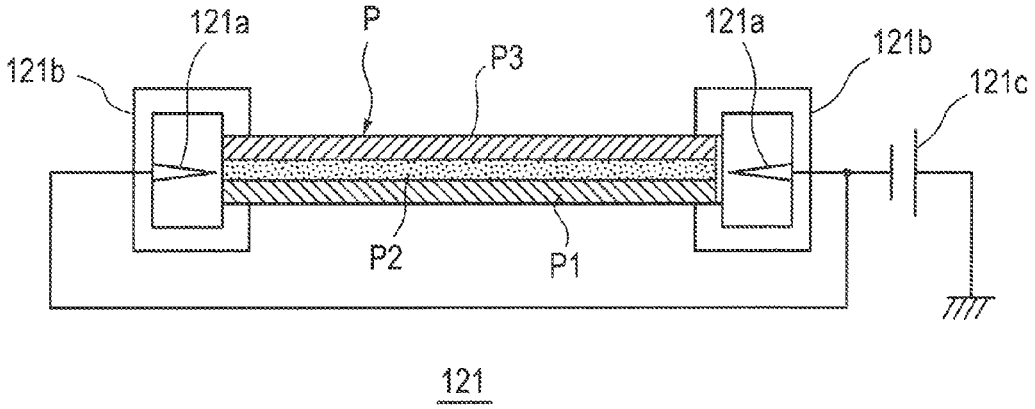
FIG. 6 illustrates a schematic configuration of a charging device of Embodiment 2.
Figure 7:
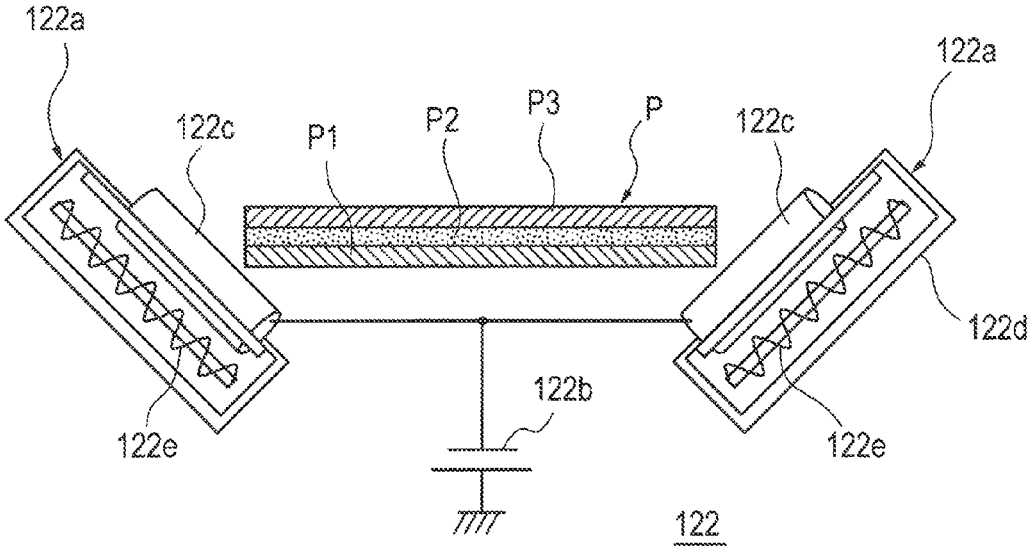
FIG. 7 illustrates a schematic configuration of a developing device of Embodiment 2.

Next, an image formation system according to Embodiment 2 of the present invention will be described. FIG. 6 illustrates a schematic configuration of charging device 121 configured as a powder supplying device (transfer-section contamination prevention device) of the image formation system according to the present embodiment. FIG. 7 illustrates a schematic configuration of developing device 122 configured as the powder supplying device of the image formation system according to the present embodiment. Charging device 121 illustrated in FIG. 6 and developing device 122 illustrated in FIG. 7 are incorporated in image forming apparatus 2. Charging device 121 is disposed on the upstream side relative to intermediate transfer unit 42 of image forming section 40 in the sheet conveyance direction. Developing device 122 is disposed at a position on the downstream side relative to charging device 121 and on the upstream side relative to intermediate transfer unit 42 in the sheet conveyance direction.

Charging device 121 is a device configured to charge adhesive agent P2 exposed at a lateral end portion of label roll sheet P. Charging device 121 includes two charging needles 121*a*, two guide members 121*b*, and power source 121*c*. Charging needle 121*a* is a charging member having a cone shape, and a negative voltage is applied to charging needle 121*a* by power source 121*c*. Guide member 121*b* is formed in a U-shape in cross-section having a gap slightly larger than the thickness of label roll sheet P. Guide member 121*b* guides charging needle 121*a* such that the tip of charging needle 121*a* faces adhesive agent P2 exposed at a lateral end portion of label roll sheet P through the gap. Guide member 121*b* having the above-mentioned configuration is disposed at each of lateral end portions of label roll sheet P.

Charging device 121 is configured as a charging section configured to charge adhesive agent P2 exposed at a lateral end portion of label roll sheet P.

Developing device 122 is a developer configured to perform development using a charged toner (charged powder) on adhesive agent P2 charged by charging device 121 and exposed at a lateral end portion of label roll sheet P. Developing device 122 includes two development units 122*a* and power source 122*b*. Development unit 122*a* includes container 122*d* (powder housing section) configured to house developing roller 122*c* having a cylindrical shape and agitation roller 122*e* having a spiral shape configured to agitate toner in container 122*d*. An image creation bias is applied from power source 122*b* to each of developing rollers 122*c* of two development units 122*a*. When the image creation bias is applied, a potential difference is generated between developing roller 122*c* and a surface of the adhesive agent of a lateral end portion of label roll sheet P in a charged state, and the surface of the adhesive agent of the lateral end portion of label roll sheet P is developed with the charged toner.

Developing device 122 is configured as a development section configured to develop adhesive agent P2 of the lateral end portion of label roll sheet P charged by charging device 121 with a charged toner. The combination of developing device 122 and charging device 121 is configured as the powder adhesion facilitation section in the present embodiment.

It is to be noted that the charging method and the development method are not limited, and a charged toner can be developed by appropriately generating a potential difference. While any of yellow, magenta, cyan, and black toners may be used, transparent toner is useful in view of checking contamination of the sheet, for example. In addition, since a toner in the form of powder is charged, excessive contamination is not caused and the amount of toner to be supplied can be minimized in comparison with the case where uncharged powder is used.

According to Embodiment 2 having the above-mentioned configuration, adhesive agent P2 exposed at a lateral end portion of label roll sheet P is charged by charging device 121 disposed on the upstream side relative to intermediate transfer unit 42 of image forming section 40 in the sheet conveyance direction of label roll sheet P, and charged toner is developed at adhesive agent P2 exposed at a lateral end portion of label roll sheet P and charged by charging device 121 by developing device 122 disposed at a position on the downstream side relative to charging device 121 and on the upstream side relative to intermediate transfer unit 42 of image forming section 40 in the sheet conveyance direction. With this configuration, even in the case where label roll sheet P is pressed at secondary transfer nip NP2 of intermediate transfer unit 42 and adhesive agent P2 leaks from the lateral end portions, transfer to the transfer section is suppressed since leaked adhesive agent P2 contains toner and its adhesiveness is low. Thus, the possibility of cleaning defects and image defects due to transfer of adhesive agent P to the transfer section is reduced.

(Embodiment 3)

Figure 8:
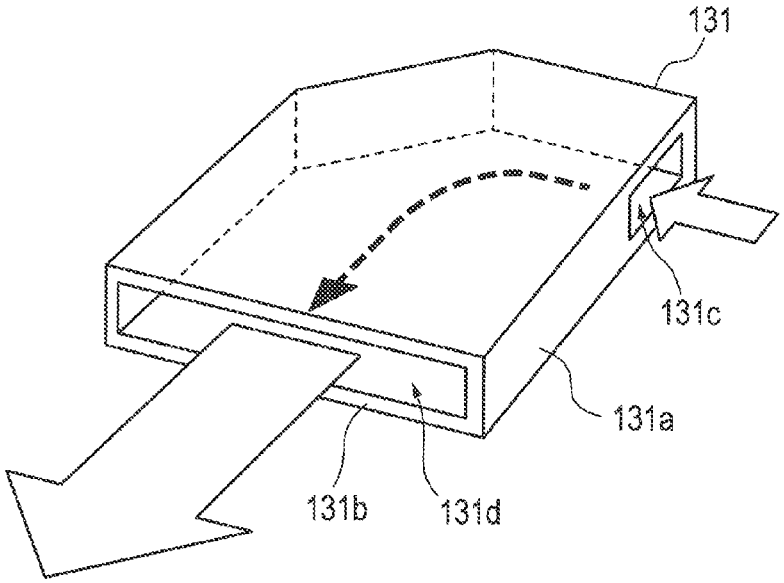
FIG. 8 is a perspective view illustrating an external appearance of a guide member of Embodiment 3.
Figure 9:
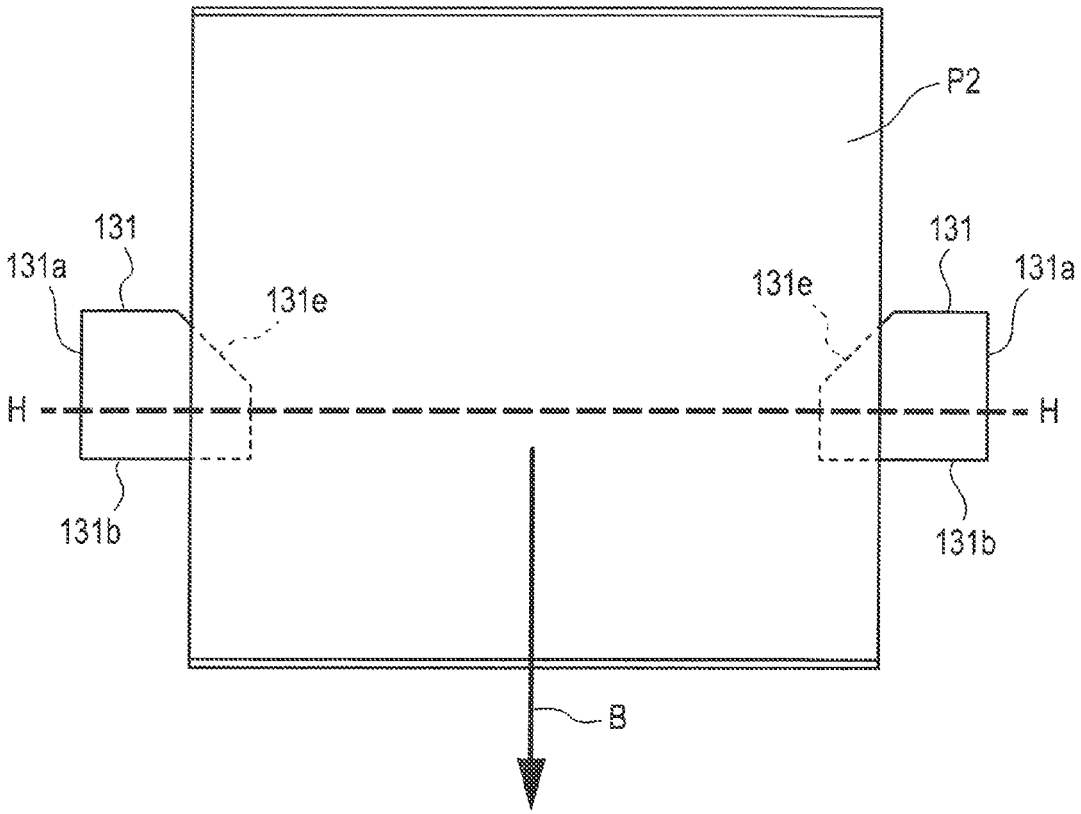
FIG. 9 is a plan view illustrating a state where the guide member of Embodiment 3 is attached to a label roll sheet.
Figure 10:
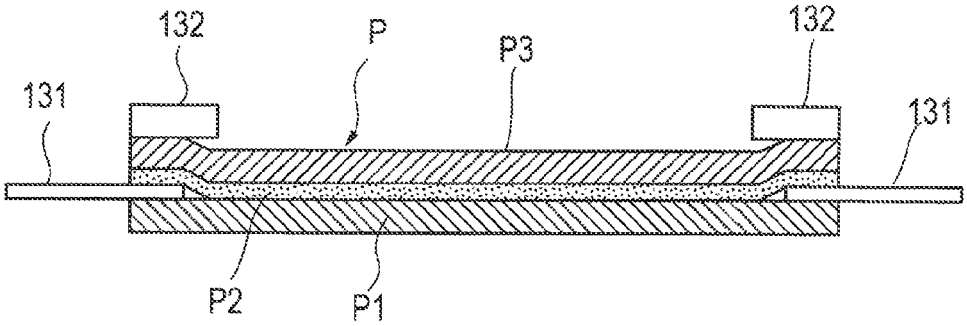
FIG. 10 is a sectional view taken along line H-H of FIG. 9.

Next, an image formation system according to Embodiment 3 of the present invention will be described. FIG. 8 is a perspective view illustrating an external appearance of guide member 131 used for a powder supplying device (transfer-section contamination prevention device) of the image formation system according to the present embodiment. FIG. 9 is a plan view illustrating a state where guide member 131 is attached to label roll sheet P. FIG. 10 is a sectional view taken along line H-H of FIG. 9. It is to be noted that base material P3 of label roll sheet P is omitted in FIG. 9 and FIG. 10.

As illustrated in FIG. 8, guide member 131 is a member having a thin hollow box shape, and, in plan view, has a pentagonal external shape which is obtained by obliquely cutting off one corner of a quadrangle. In guide member 131, powder inlet 131*c* and powder outlet 131*d* are provided on side surface 131*a* and on side surface 131*b*, respectively. Powder outlet 131*d* is formed in a size which occupies substantially the entire side surface 131*b*, and powder inlet 131*c* is formed in a size which occupies about 30% of side surface 131*a*. To powder inlet 131*c*, powder is supplied from a powder housing chamber not illustrated which is similar to powder housing chamber 832 illustrated in FIG. 5. The powder having entered guide member 131 through powder inlet 131*c* is ejected from powder outlet 131*d*. It is to be noted that dusting powder mainly composed of starch is used as the powder as described in Embodiment 1, for example.

Here, the surface of guide member 131 is formed of PFA (tetra fluoroethylene-perfluoroalkyl vinyl ether copolymer), or guide member 131 is formed using a material such as P1 (polyimide) and a ceramic so that guide member 131 does not adhere to adhesive agent P2 of label roll sheet P, for example.

Guide member 131 is attached to a lateral end portion of label roll sheet P at a position on the upstream side relative to intermediate transfer unit 42 of image forming section 40 in the sheet conveyance direction of label roll sheet P. Specifically, as illustrated in FIG. 9, guide member 131 is attached to a lateral end portion of label roll sheet P such that side surface 131*a* provided with powder inlet 131*c* is parallel to the sheet conveyance direction, that side surface 131*b* provided with powder outlet 131*d* is orthogonal to the sheet conveyance direction, and that a portion on inclined surface 131*e* side thereof is put between adhesive agent P2 and release sheet P3 of label roll sheet P.

In addition, as illustrated in FIG. 10, a portion of guide member 131 interposed in label roll sheet P is pressed by opposing member 132 disposed on base material P3 at a lateral end portion of label roll sheet P. By pressing the portion of guide member 131 interposed in label roll sheet P with opposing member 132, guide member 131 can be fixed, and guide member 131 does not move along with conveyance of label roll sheet P. Guide member 131 is attached in a stopped state before printing on label roll sheet P is started.

Figure 11:
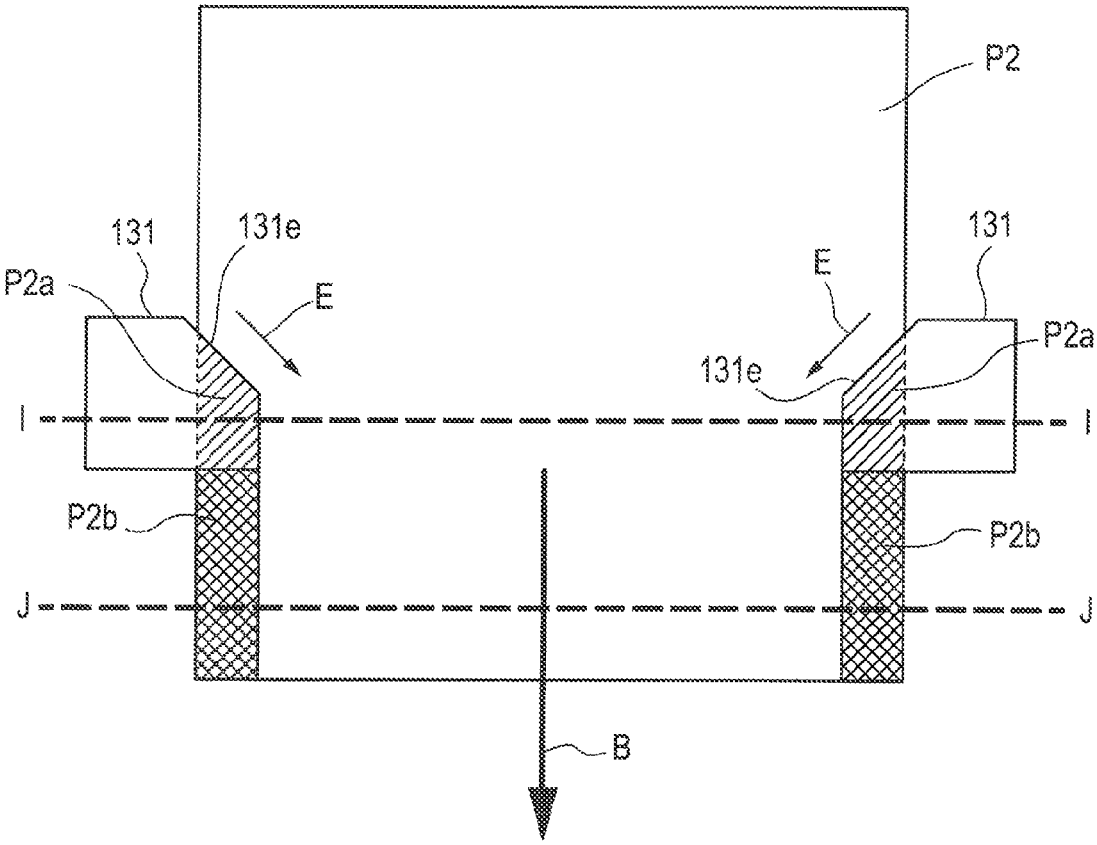
FIG. 11 is a plan view for describing an operation of the guide member of Embodiment 3.

When printing on label roll sheet P is started after guide member 131 is attached to label roll sheet P, supply of powder to guide member 131 is started. On/off of supply of the powder is performed by control section 101. As illustrated in FIG. 11, label roll sheet P is conveyed when printing on label roll sheet P is started. It is to be noted that base material P3 of label roll sheet P is omitted in FIG. 11. During conveyance of label roll sheet P, adhesive agent P2 of label roll sheet P is brought toward the center of the sheet (arrow E direction in the drawing) by inclined surface 131*e* of guide member 131. With this configuration, the amount of adhesive agent P2 of the lateral end portion of label roll sheet P is reduced. In addition, adhesive agent P2, the amount of which is small, passes over the top surface of a part of guide member 131 interposed in label roll sheet P along with conveyance of label roll sheet P. The powder supplied to guide member 131 adheres to the small amount of adhesive agent P2. Adhesive agent P2*a* illustrated in FIG. 11 is adhesive agent passing over the top surfaces of end portions of guide member 131. In addition, adhesive agent P2*b* illustrated in FIG. 11 is adhesive agent that has passed over the top surfaces of the end portions of guide member 131, on which powder has been attached.

Guide member 131 can be interposed from a lateral end portion of label roll sheet P between base material P3 and release sheet P1 of label roll sheet P and is formed in a hollow form. Guide member 131 includes opening 131*d* capable of supplying powder to the inside of label roll sheet P. In the present embodiment, guide member 131 is configured as the powder housing section. In the present embodiment, pump 833*a* described in Embodiment 1 may be used as an output section configured to output powder to the inside of label roll sheet P through guide member 131, for example.

Figure 12:
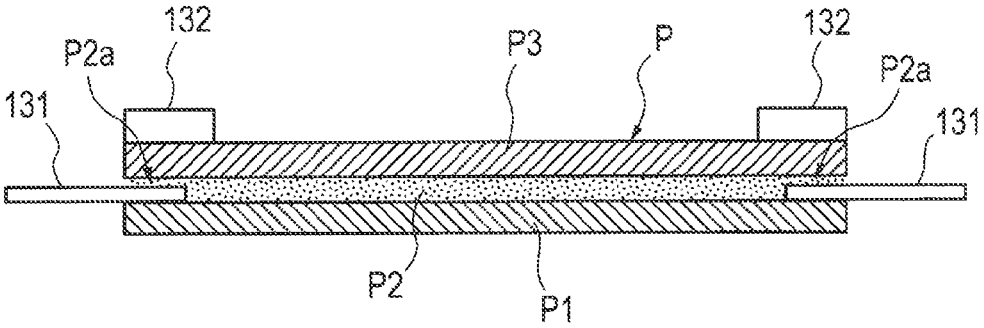
FIG. 12 is a sectional view taken along line I-I of FIG. 11.
Figure 13:
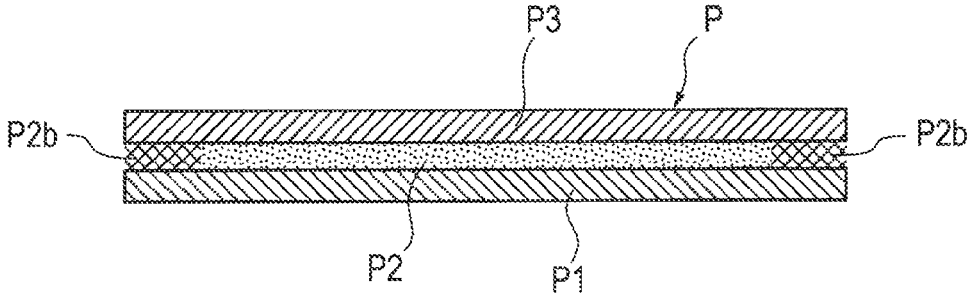
FIG. 13 is a sectional view taken along line J-J of FIG. 11.

FIG. 12 is a sectional view taken along line I-I of FIG. 11, and FIG. 13 is a sectional view taken along line J-J of FIG. 11. As illustrated in FIG. 12, a small amount of adhesive agent P2*a* is present on the top surface of the inserted portion of guide member 131 in label roll sheet P. In addition, as illustrated in FIG. 13, adhesive agent P2*b* on which powder is attached is present at the lateral end portions of label roll sheet P.

The adhesiveness of adhesive agent P2 on which powder is attached is low, and the amount of which is small, and therefore, almost no transfer to the transfer section is caused when label roll sheet P passes through secondary transfer nip NP2 of intermediate transfer unit 42 (see FIG. 4).

According to Embodiment 3 having the above-mentioned configuration, with guide member 131 disposed on the upstream side relative to intermediate transfer unit 42 of image forming section 40 in the sheet conveyance direction of label roll sheet P, adhesive agent P2 of the lateral end portions of label roll sheet P is brought toward the center of the sheet, and powder is supplied to the lateral end portions of label roll sheet P and attached to adhesive agent P2*a* remaining at the lateral end portions of label roll sheet P. With this configuration, almost no adhesive agent P2 of the lateral end portions of label roll sheet P leaks even when label roll sheet P is pressed at secondary transfer nip NP2 of intermediate transfer unit 42, and even if adhesive agent P2 leaks, transfer to the transfer section is suppressed since the adhesive agent P2*b* contains the powder and its adhesiveness is low. Thus, the possibility of cleaning defects and image defects due to transfer of adhesive agent P to the transfer section is reduced.

Figure 14:
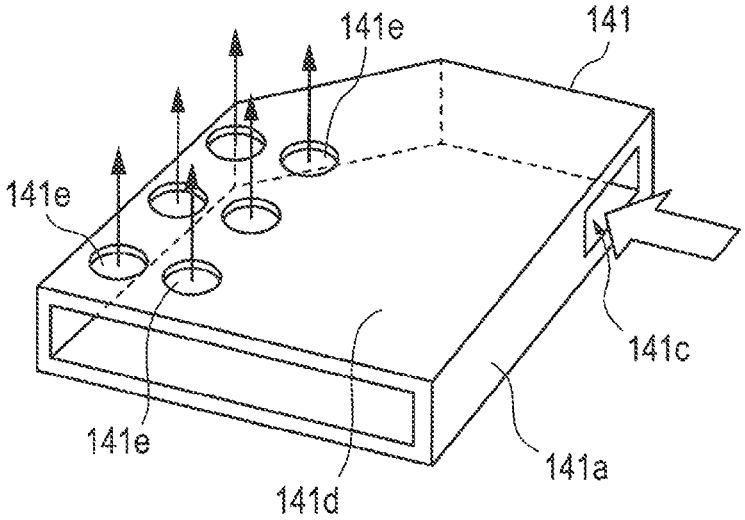
FIG. 14 is a perspective view illustrating an external appearance of a modification of the guide member of Embodiment 3.

While guide member 131 of Embodiment 3 includes one powder outlet 131*d* on each side surface 131*b*, most of adhesive agent P2*a* remaining at the lateral end portions of label roll sheet P passes over the top surface the inserted portion of guide member 131 in label roll sheet P, and therefore the powder outlet may be provided on the top surface. FIG. 14 is a perspective view illustrating an external appearance of an example of guide member 141. As illustrated in FIG. 14, side surface 141*a* is provided with powder inlet 141*c*, and top surface 141*d* is provided with a plurality of powder outlets 141*e*.

(Embodiment 4)

Figure 15A:
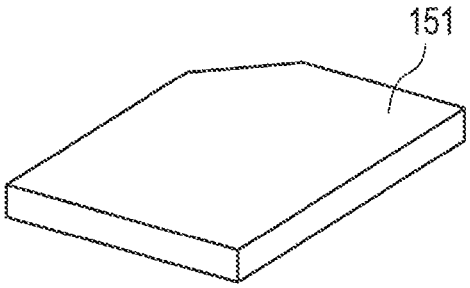
FIG. 15A is a perspective view illustrating an external appearance of a first example of a guide member of Embodiment 4.
Figure 15B:
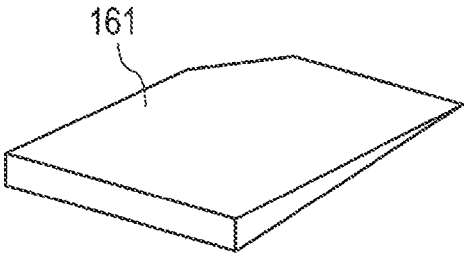
FIG. 15B is a perspective view illustrating an external appearance of a second example of a guide member of Embodiment 4.
Figure 16:
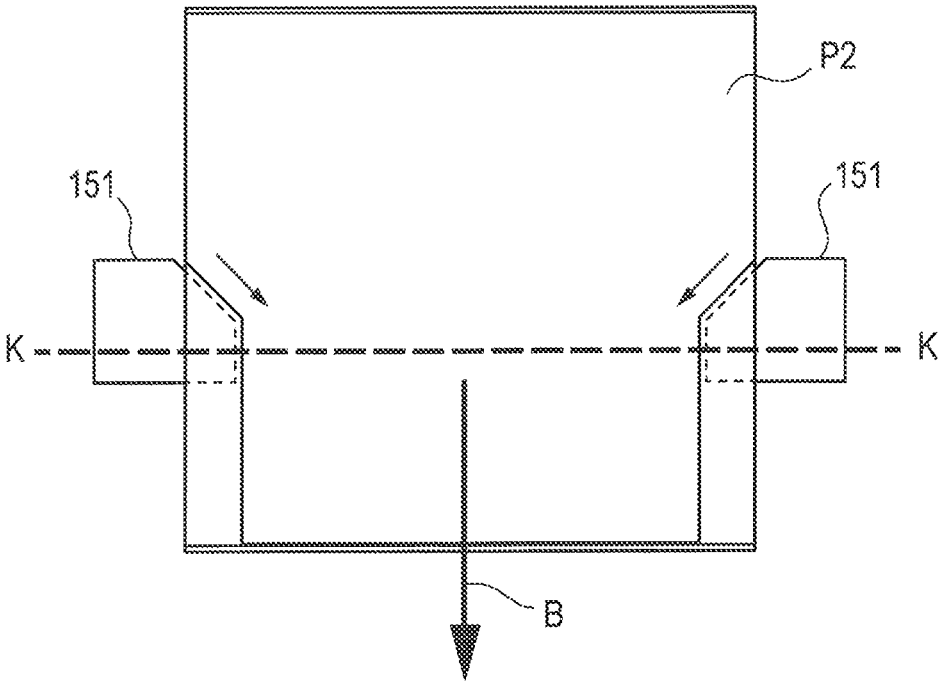
FIG. 16 is a plan view for describing an operation of the guide member of Embodiment 4.

Next, an image formation system according to Embodiment 4 of the present invention will be described. Guide member 131 of Embodiment 3 can reduce the amount of adhesive agent P2 of lateral end portions of label roll sheet P with only its shape, and therefore a comparable effect can be achieved even when the structure through which powder passes is omitted. In addition, since the structure through which powder passes is not provided, cost can be reduced. FIGS. 15A and 15B illustrate an exemplary guide member in which the structure through which powder passes is omitted. Guide member 151 illustrated in FIG. 15A has a pentagon shape as with guide member 131 and has a certain thickness. Guide member 161 illustrated in FIG. 15B also has a pentagon shape as with guide member 131, but its thickness gradually decreases toward the end. Since the thickness of the end portion is small, guide member 161 can be easily inserted between release sheet P1 and adhesive agent P2 of label roll sheet P. When guide member 151 is attached at a lateral end portion of label roll sheet P, adhesive agent P2 of the lateral end portion of label roll sheet P is brought toward the center of the sheet along with conveyance of label roll sheet P as illustrated in FIG. 16. It is to be noted that, in FIG. 16, base material P3 of label roll sheet P is omitted. FIG. 17 is a sectional view taken along line K-K of FIG. 16. As illustrated in FIG. 17, while most of adhesive agent P2 is brought toward the center of the sheet by guide member 151, a small amount of adhesive agent P2 passes over the top surface of the inserted portion of guide member 131 in label roll sheet P.

It should be understood by those skilled in the art that various modifications, combinations, sub-combinations and alterations may occur depending on design requirements and other factors in so far as they are within the scope of the appended claims or the equivalents thereof.

Finally, results of experiments for confirming the effectiveness of the above-mentioned embodiments will be described. To confirm the effectiveness, among an image formation system of a comparative example in which no measures are taken against leakage of adhesive agent P2 and the above-mentioned image formation systems of Embodiments 1 to 4, image defects of white streak in the case where SRA3-halftone image is collected in the FD-direction, and the transfer amounts of adhesive agent P2 after A3-label roll sheet P is continuously conveyed for 2 km were compared. FIG. 18 shows results of experiments for confirming the effectiveness of the present invention. In FIG. 18, "good," "fair," and "poor" respectively represent the following results.

Transfer of adhesive agent good: no transfer to transfer R was found fair: a small amount of transfer to transfer R was found (no practical problem was found)

poor: a large amount of transfer to transfer R was found

White streak image good: no streak image was found fair: a small amount of streak image was found (no practical problem was found)

poor: a large amount of streak image was found

As can be seen in FIG. 18, in the case of the comparative example, minor defects (transfer of adhesive agent and streak image) were caused at 0.5 km, and serious defects were caused at 1 km. In the cases of Embodiments 1 to 3, no defects were caused, and favorable results were obtained. While minor defects were caused after 1.5 km in the case of Embodiment 4, the obtained result was better than that of the comparative example.

REFERENCE SIGNS LIST

1 Sheet feeding apparatus
2 Image forming apparatus
3 Sheet ejection apparatus
10 Image reading section
20 Operation display section
30 Image processing section
40 Image forming section
42 Intermediate transfer unit
50 Sheet conveyance section
53 Conveyance path section
60 Fixing section
72 Storage section
83 Powder supplying device
84 Adhesive agent collection device
102 CPU
103 ROM
104 RAM
121 Charging device
122 Developing device
121*a* Charging needle
121*b*, 131, 141, 151, 161 Guide member
121*c*, 122*b* Power source
122 Developing device
122*a* Development unit
122*c* Developing roller
122*d* Container
122*e* Agitation roller
132 Opposing member
421 Intermediate transfer belt
423B Backup roller
424 Secondary transfer roller
831 Shield member
832 Powder housing chamber
833*a*, 833*b* Pump
834 Pipe
842 Suction duct
NP2 Secondary transfer nip
P Label roll sheet
P1 Release sheet
P2 Adhesive agent
P3 Base material

What is claimed is:

1. A transfer-section contamination prevention device comprising:

a powder housing section that is disposed on an upstream side relative to a transfer section in a sheet conveyance direction, the powder housing section configured to hold powder at a position near a lateral edge of a sheet in a sheet thickness direction orthogonal to the sheet conveyance direction or configured to guide the powder to the position near the lateral edge of the sheet, the powder housing section including a hollow member having an opening through which the powder is supplied to the lateral edge of the sheet or to an inside of the sheet, the sheet including a base material layer, a release layer and an adhesive layer containing adhesive agent disposed between the base material layer and the release layer, the transfer section being configured to transfer a toner image to the sheet; and a powder adhesion facilitation section configured to facilitate adhesion of the powder to the lateral edge of the sheet from the powder housing section.

2. The transfer-section contamination prevention device according to claim 1, wherein the hollow member is a shield member configured to enclose the adhesive layer exposed at the lateral edge of the sheet, and the powder adhesion facilitation section includes a dispersion section configured to disperse the powder in an interior of the shield member.

3. The transfer-section contamination prevention device according to claim 1, wherein the powder is a charged powder, and the powder adhesion facilitation section includes:

a charging section configured to charge the adhesive layer exposed at the lateral edge of the sheet; and a development section configured to develop with the charged powder the adhesive layer at the lateral edge of the sheet charged by the charging section.

4. The transfer-section contamination prevention device according to claim 1, wherein:

the hollow member is a guide member that is interposable between the base material layer and the release layer of the sheet from the lateral edge of the sheet; and the power adhesion facilitation section includes an output section configured to output the powder to the inside of the sheet through the guide member.

5. The transfer-section contamination prevention device according to claim 4, wherein the guide member brings the adhesive agent of the adhesive layer toward a center of the sheet when the guide member is interposed between the base material layer and the release layer of the sheet from the lateral edge of the sheet.

6. The transfer-section contamination prevention device according to claim 1 further comprising a collection section disposed on a downstream side relative to the transfer section in the sheet conveyance direction and configured to suck the adhesive agent on which the powder is attached from the lateral edge of the sheet and collect the adhesive agent.

7. An image forming apparatus comprising the transfer-section contamination prevention device according to claim 1.

8. The image forming apparatus according to claim 7, wherein the hollow member is a shield member configured to enclose the adhesive layer exposed at the lateral edge of the sheet, and the powder adhesion facilitation section includes a dispersion section configured to disperse the powder in an interior of the shield member.

9. The image forming apparatus according to claim 7, wherein the powder is a charged powder, and the powder adhesion facilitation section includes:

a charging section configured to charge the adhesive layer exposed at the lateral edge of the sheet; and a development section configured to develop with the charged powder the adhesive layer at the lateral edge of the sheet charged by the charging section.

10. The image forming apparatus according to claim 7, wherein:

the hollow member is a guide member that is interposable between the base material layer and the release layer of the sheet from the lateral edge of the sheet; and the powder adhesion facilitation section includes an output section configured to output the powder to the inside of the sheet through the guide member.

11. The image forming apparatus according to claim 10, wherein the guide member brings the adhesive agent of the adhesive layer toward a center of the sheet when the guide member is interposed between the base material layer and the release layer of the sheet from the lateral edge of the sheet.

12. The image forming apparatus according to claim 7 further comprising a collection section disposed on a downstream side relative to the transfer section in the sheet conveyance direction and configured to suck the adhesive agent on which the powder is attached from the lateral edge of the sheet and collect the adhesive agent.

* * * * *